United States Patent [19]

Franc

[11] 4,114,206

[45] Sep. 19, 1978

[54] AUTOMATIC SWIMMING POOL CLEANING SYSTEM

[76] Inventor: Eugene K. Franc, P.O. Box 332, San Rafael, Calif. 94901

[21] Appl. No.: 740,910

[22] Filed: Nov. 11, 1976

[51] Int. Cl.[2] ..... E04H 3/16; E04H 3/18

[52] U.S. Cl. ..... 4/172; 4/172.15; 4/172.17; 134/167 R; 134/168 R

[58] Field of Search ..... 4/172, 172.18, 172.17, 4/172.15; 210/169; 134/10, 167, 168

[56] References Cited

U.S. PATENT DOCUMENTS

| | | | |
|---|---|---|---|
| 3,018,491 | 1/1962 | Read | 4/172.17 |
| 3,045,829 | 7/1962 | Rule et al. | 4/172.17 X |
| 3,432,867 | 3/1969 | Whitten, Jr. | 4/172.17 |
| 3,449,772 | 6/1969 | Werner | 4/172.15 |
| 3,506,489 | 4/1970 | Baker | 4/172.17 X |
| 3,675,252 | 7/1972 | Ghiz | 4/172.17 |

*Primary Examiner*—Henry K. Artis
*Attorney, Agent, or Firm*—Phillips, Moore, Weissenberger, Lempio & Majestic

[57] ABSTRACT

An automatic cleaning system for swimming pools connected to a source of fluid pressure and having a control system for allowing fluid to escape through the jets in predetermined cycles is provided. The cycling of the jets provides a sweeping action across the inner surface of the pool so that debris and sediment are progressively moved to the pool drain opening. The jets are used in conjunction with a fluid manifold system which permits the cycling to be accomplished. The fluid manifold system is conveniently fixed to the inner surface of existing pools near the water level and adjacent to the coping, or an in ground manifold system may be used in conjunction with in place wall fittings as in the case of new pool construction. The jets may be of an adjustable nature and may remain in a fixed position or allowed to oscillate. By adjusting and angling the jets, predesigned current patterns are developed so that dirt and other debris is dislodged from the inner surface of the pool and carried or moved to the main drain. The jets are adjustable so that the current patterns from the jet may effect the cleaning of the pool of any configuration. A debris collection trap for placement over the drain is also provided. This trap permits removal of larger debris, thereby preventing it from obscuring or blocking the main drain.

8 Claims, 10 Drawing Figures

FIG_6
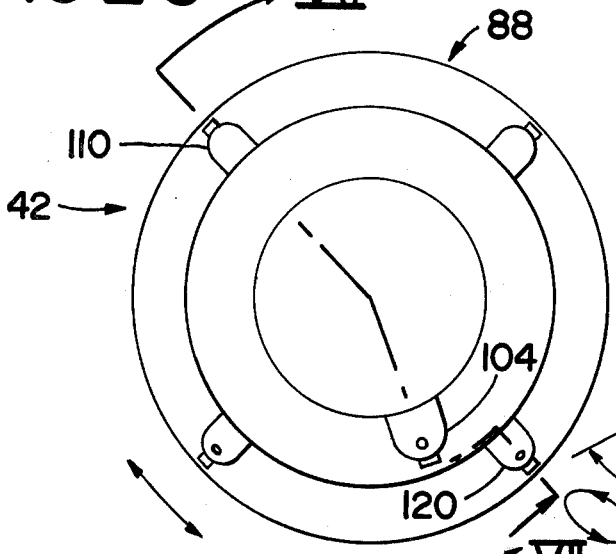
FIG_7
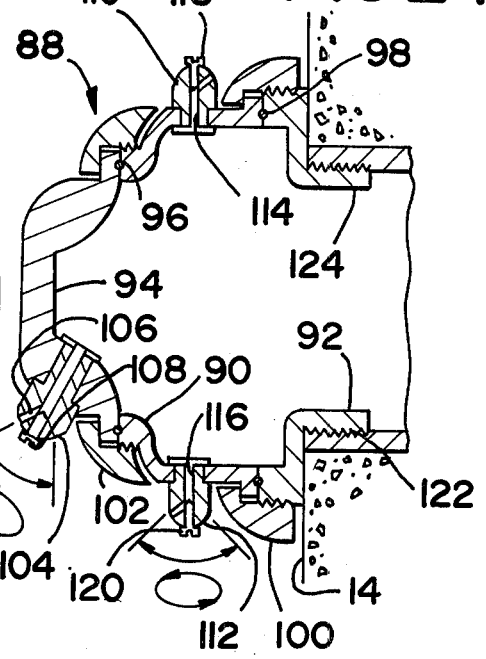
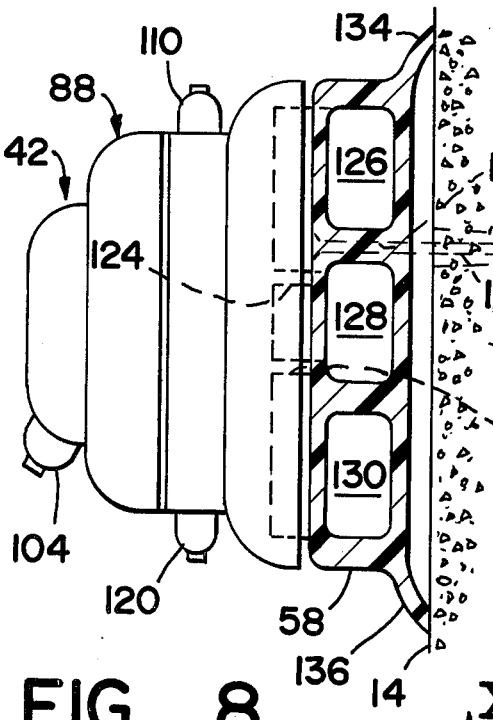
FIG_8
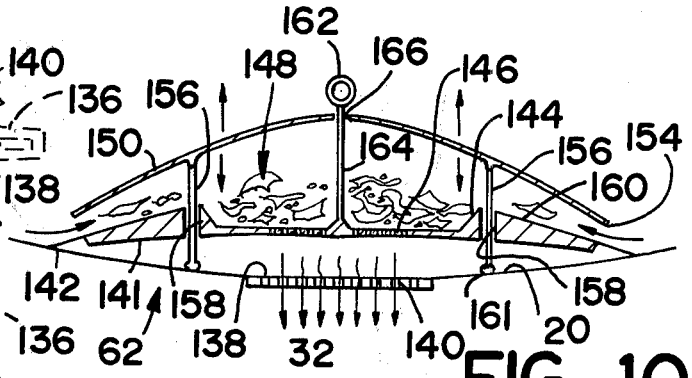
FIG_10
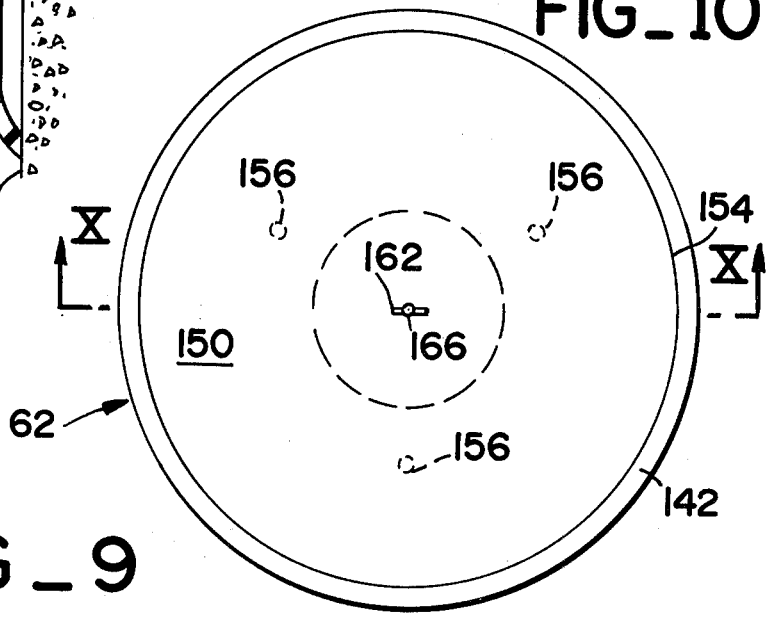
FIG_9

AUTOMATIC SWIMMING POOL CLEANING SYSTEM

CROSS REFERENCE TO DOCUMENT DISCLOSURE

Reference is made to Disclosure Document Nos. 044,989 of Nov. 17, 1975; 047,529 of Mar. 8, 1976; and 048,632 of Apr. 16, 1976, in relation to the instant invention.

BACKGROUND OF THE INVENTION

This invention relates to an automatic cleaning system for pools such as swimming pools. More particularly, this invention relates to a swimming pool cleaning system which automatically develops various current patterns about the pool so as to dislodge accumulated dirt and debris from the inner surface thereof and sweep it to the main drain for removal.

Many prior art automatic swimming pool cleaners are known. These prior art cleaners in the main are characterized by their relative complexity and high cost. Others of these prior art devices are inefficient in operation and have many drawbacks in their ability to clean irregular pool surfaces.

One such prior art device is shown in U.S. Pat. No. 3,032,044 to Pansini. This prior art swimming pool cleaner is exemplary of the type which floats within the pool and moves relative to the inner surface thereof for effecting its cleaning action. This type of device has a number of deficiencies including a very basic one of occupying fluid space in the pool and thereby obstructing free use thereof on the part of swimmers. Attempts to overcome this deficiency have taken the form of built-in cleaning systems such as shown in U.S. Pat. No. 3,521,304 to Ghiz. With this type of device, jets are disposed on the inner surface of the pool and positioned so as to deliver jet streams substantially parallel to the surfaces of the inner surfaces, i.e. the walls and bottom portions of the pool. However, this type of device merely stirs the sediment of debris into suspension whereby it is theoretically removed by the filtering system of the pool water circulating apparatus. This is highly inefficient and ineffective because by keeping these dirt particles constantly stirred up in a vast area of suspension very little of this sediment will ever pass through the main drain or surface skimmer in any reasonable time period of the filter cycle, i.e. sediments would tend to accumulate faster than they could be removed. Also, heavier particles tend not to go into suspension or to go into suspension near the pool bottom. Obviously, these heavier particles will not be taken away efficiently if they are constantly being moved about the pool arbitrarily.

SUMMARY AND OBJECTS OF THE INVENTION

It is therefore the primary object of the present invention to provide an improved automatic swimming pool cleaning system which is readily adapted to various pools to remove accumulated dirt and debris from the inner surface thereof.

It is a further object of the present invention to provide an improved automatic swimming pool cleaning system which is relatively simple and inexpensive to construct and incorporates a number of elements which cooperate to effect a more efficient cleaning of the pool inner surface than was previously the case.

It is a further object of the present invention to provide such a cleaning system which is adapted for use in cleaning irregular surfaces of the pool such as steps, tile, etc.

It is a still further object of this invention to provide such a pool cleaning system wherein a plurality of main jets located around the pool periphery are used in conjunction with a control system for alternately directing fluid to the various jets, thereby producing a sweeping action of debris and dirt towards and into the pool main drain and surface skimmer.

It is a further object of this invention to provide such a system with main jets as well as secondary jets for cleaning pool surfaces.

It is a still further object of this invention to provide such a system which includes a large debris trap which effectively screens such material away from the main drain.

It is a still further object of this invention to provide an improved manifold conduit system utilizable with already existing pools to supply the multiple fluid jet cycles of the cleaning system.

Still a further object of this invention is to provide an improved in ground manifold conduit system utilizing in place wall fittings as in new pool construction to supply the multiple fluid jet cycles of the cleaning system.

It is a still further object to provide such a system which produces cleaning cycles in a cleaning pattern, such as the "saw tooth" pattern illustrated and other patterns.

This invention takes the form of an automatic pool cleaning system comprising a plurality of fluid nozzles or jets which are positioned around the periphery of the pool. The jets are used in conjunction with a manifold which leads from a control system for directing fluid from a source of fluid pressure to and through the jets. The control system causes fluid to be directed alternately to the jets in controlled cycles, thereby causing dirt and debris to be swept along the pool inner surface toward the main drain. In this connection, it is contrasted with prior art devices which merely stir up the sediments into constant suspension during the time of the filter cycle. The jets are conveniently mounted on a manifold for distribution of fluid thereto, which manifold may conveniently be an elongated conduit having a plurality of fluid passages therein and mounted to the inner surface of the pool. Alternatively, the jets may be mounted on in place wall fittings connected to an in ground manifold conduit system as in the case of new pool construction.

The control system may be set for a variation of cycles in number and duration. By so doing, dirt and debris are effectively directed to the main drain. A large debris trap which is placed over the main drain and used in conjunction with the system permits the removal of such large debris so that it is prevented from clogging the main drain.

Additional jets may be used in conjunction with the aforementioned jet in a second embodiment, so as to stir or dislodge dirt particles into suspension for removal by the surface skimmer. The timing of the cleaning cycles is controlled by regulating the fluid manifold and adjusting the operational time of the filter system, which is typically the source of fluid pressure for operating the jets.

Further and other objects and advantages of this invention will become more readily apparent from a review of the following description and accompanying drawings.

BRIEF DESCRIPTION OF THE DRAWINGS

FIG. 6 is a front elevational view of a jet in accordance with the instant invention;

FIG. 7 is a side elevational cross-sectional view taken along lines VII—VII in FIG. 6, showing a jet connected to an in place wall fitting;

FIG. 8 is a side elevational view in partial cross section of a jet mounted on a manifold conduit in accordance with the instant invention;

FIG. 9 is a top plan view of a debris trap in accordance with the instant invention; and, FIG. 10 is a side elevational cross-sectional view taken along lines X—X in FIG. 9, and illustrating details thereof.

DETAILED DESCRIPTION

Figure 1:
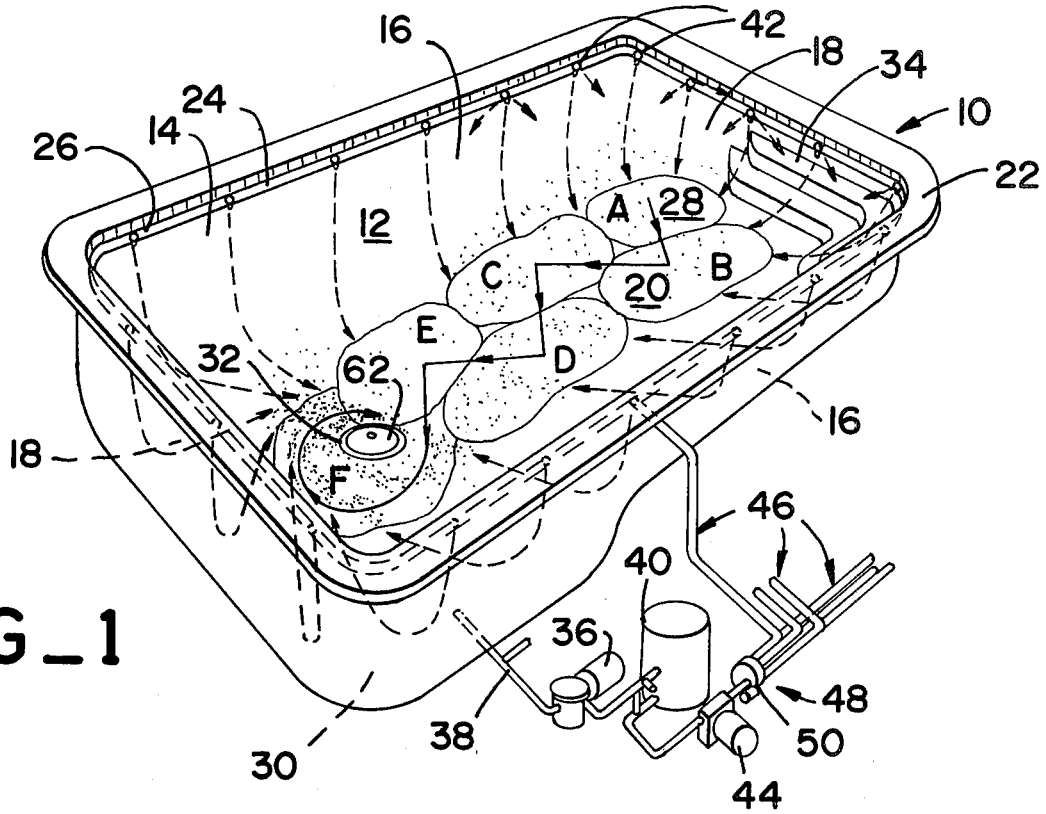
FIG. 1 shows a top-quarter isometric view of a swimming pool and automatic cleaning system therefor in accordance with the present invention.
Figure 2:
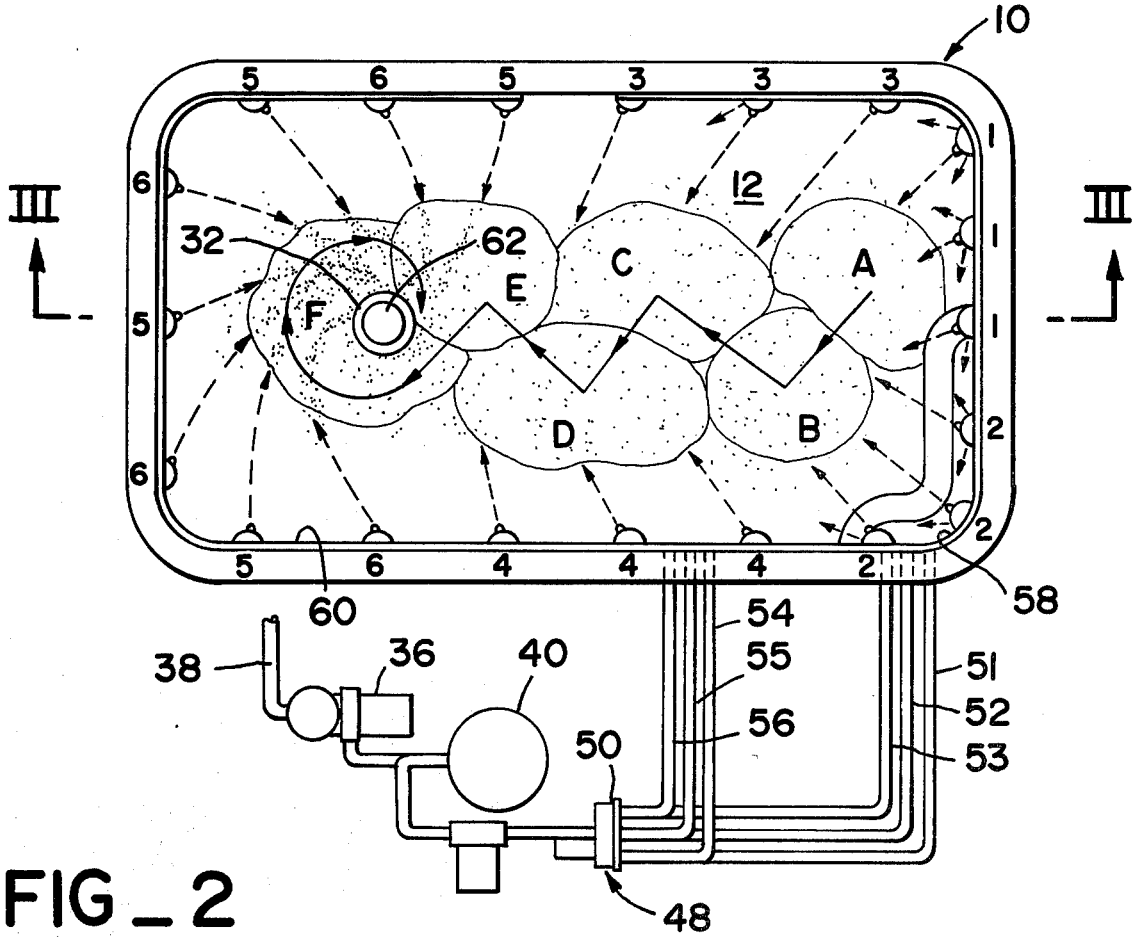
FIG. 2 is a top plan view thereof, illustrating cleaning patterns within the pool.
Figure 3:
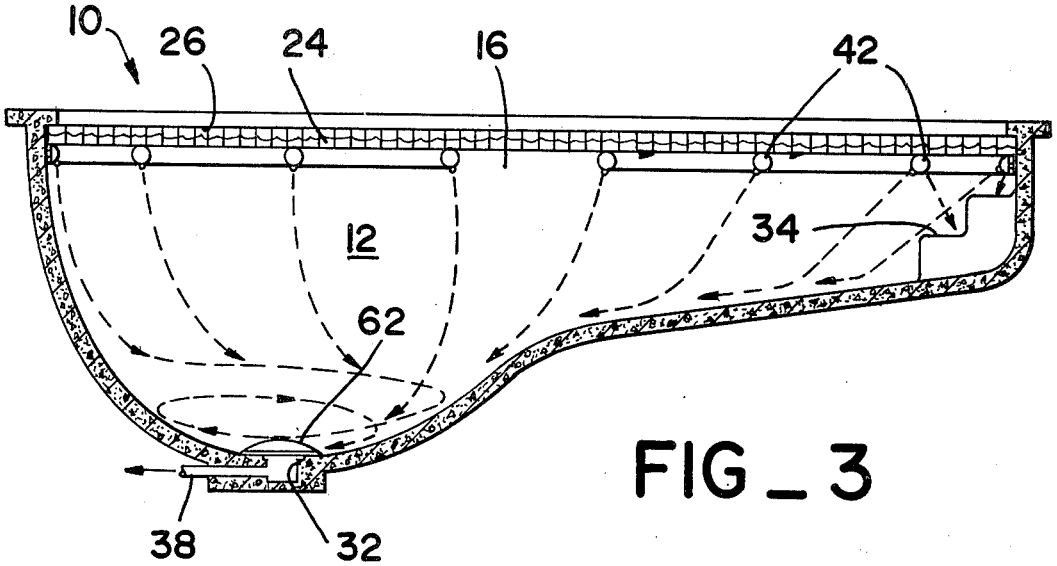
FIG. 3 is a side cross-sectional elevational view taken along lines III—III in FIG. 2.
Figure 5:
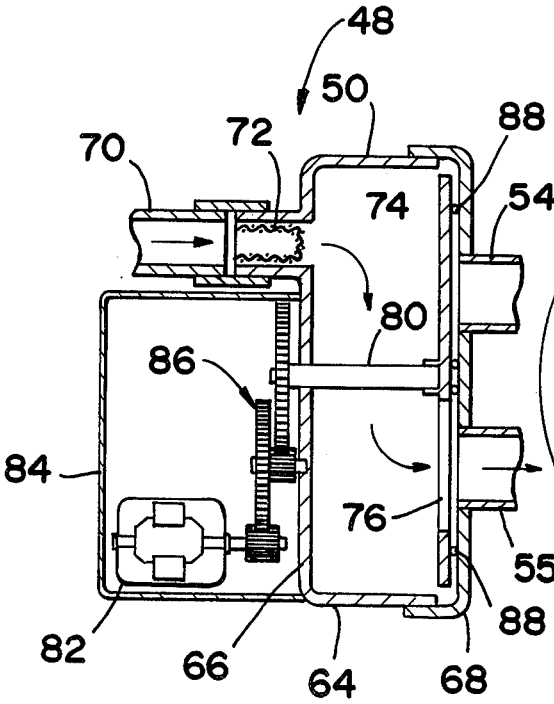
FIG. 5 is a front elevational view in cross-section, taken along lines V—V in FIG. 4 of the same.
Figure 4:
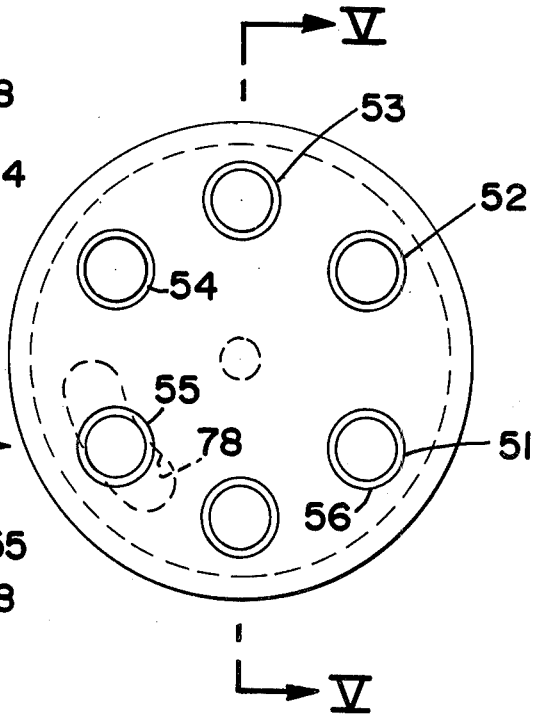
FIG. 4 is a side elevational view of a part of the control system.

Turning to FIGS. 1 through 3, there is shown generally at 10 a swimming pool containing a body of fluid such as water 12. The pool itself may be formed of any convenient material such as fiberglass or reinforced concrete. The pool itself may be rectangularly or regularly shaped as shown, or of an irregular shape. The pool defines an inner surface 14, which is made up of a pair of side walls 16, a pair of end walls 18, all joined by a bottom 20. The upper peripheral edge of the pool includes a coping 22 therearound. The water level 24 of the body of water 12 is typically as shown at approximately the lowermost portion of the coping 26.

As shown, the pool 12 may typically have a shallow end 28 and a deep end 30, the latter containing a drain opening 32. A plurality of steps 34 at shallow end 28 is typical for this type of pool.

Turning particularly to FIGS. 1 and 2, the filter system will now be described. As is known in the art, water must be periodically drawn from the pool and cleansed by filtration. This is accomplished by means of a main pump 36 which draws water from the pool through a drain return line 38 and thence passes it into a filter 40, which may contain diatomaceious earth or some such filtering medium. In the typical case, filtered fluid is then passed back into the pool through a plurality of return lines and a corresponding number of return nozzles located on the inner walls thereof. In the instant invention, an automatic pool cleaning system is provided as follows.

A plurality of jets 42, as will be hereinafter described, are located in spaced relation around the pool periphery in the proximity of the coping 22. These jets are directed as shown by the dotted arrows so as to produce a scouring action along the pool inner surface 14, as shown. A booster pump 44 as required draws water from filter 40 to return lines 46 by way of a fluid jet control system 48 as will be more fully described hereinafter.

Still referring to FIGS. 1 and 2, the operation of a single cleaning cycle will now be described. It must be first appreciated that the control system 48 provides for the separate, serial actuation of certain ones of the plurality of jets 42 located around the pool periphery. Having reference to FIG. 2, it may be noted that six sets of jets, numbered 1 through 6, corresponding with six subcycles of a complete cycle have been identified. In operation, a fluid timing means such as a rotary valve 50 is used to serially direct fluid from booster pump 44 though a corresponding plurality of lines 51 though 56, in turn, to effect a sweeping or cleaning action in the pool.

As may be seen, in operation the rotary valve directs fluid first through line 51 in the fluid manifold conduit 58 which supplies subcycle jets 1. Then it directs fluid through lines 52 and 53 supplying sybcycle jets 2 and 3. Similarly, subcycle jets 4 through 6 are supplied through a fluid manifold conduit 60 through lines 54 through 56. In the first subcycle, the fluid is directed through line 51 and manifold 58 to the three jets of the first cycle, designated 1. These three jets are oriented to sweep from the sidewalls and area A in the bottom of the pool 20, causing any dirt and debris to be moved or forced into area B over the time of the subcycle. This commences the time of the second subcycle, whereupon the jets designated 1 become inoperative, and fluid is directed through line 52 to actuate jets numbered 2. These jets in turn sweep area B into area C. Obviously, the sediment and debris that has been swept into area B from area A, together with whatever sediment existed in area B is now moved into area C over the second subcycle time.

Thus begins the third subcycle, wherein fluid is directed through line 53 to energize jets 3, which sweep area C into area D. Subsequent subcycles energize jets 4, jets 5, and then jets 6 in turn.

The movement of the sediment and debris along the pool bottom is from right to left, as viewed in the Figure, and in rough accordance with the arrow direction shown.

As may perhaps be best seen in FIG. 3, the dirt and sediment are finally swept into drain opening 32 through a leaf or large debris trap 62, as will be more fully described hereinafter. As may be appreciated, the path of sweeping is in a zig-zag direction or any predesigned current patterns longitudinally across the pool from shallow to deep end by a first group of jets until the vicinity of the drain 32 is reached. At this point a second group of jets jets 5 and 6 are cycled to impart a spiral motion to the sediment and debris, causing it to enter the drain opening 32 through leaf or debris trap 62.

Sediment and smaller debris is then taken away through return line 38 and filtered. Thus, an efficient automatic pool cleaning system is provided which utilizes the inherent pool filtration system for effecting cleaning.

Obviously, cycles may be repeated which incorporate subcycles 1 through 6 or any number of subcycles as desired during the normal filter cycle. It should be readily apparent that the cycles shown are merely illustrative, and any combination of jet cycles and cleaning patterns may be incorporated depending upon the size, shape, etc. of the pool involved.

In addition, and as an alternate to the about to be described rotary valve control system, a plurality of electrically operated solenoid valves actuated by cycle timer means may be used. It suffices to say that control means which operate to direct fluid alternatively to various points of distribution in a desired time cycle may be used interchangeably.

With particular reference to the control system of the present invention, such comprises a generally cylindrical housing 64 which has a closed bottom end 66 and an open end covered over by means of a cylindrically shaped cover 68.

The various return lines 51 through 56 are sealingly mounted within accomodating apertures within cover 68. Fluid entering through line 70 is passed through a finger screen 72 to trap dirt and debris particles which might otherwise foul the jets. Fluid then enters chamber 74 of valve housing 64. A circular disc 76, having an elongated port 78 therein, is mounted on a shaft 80 and journalled in bottom end 66 for rotation.

Rotation of shaft 80 and disc 76 is accomplished by means of an electric motor 82 contained within a housing 84. Motor 82 is drivingly connected to shaft 80 by a plurality of gears forming a gear train 86. The selection of gears, together with the size of elongated port 78 determines the duration of the subcycle. It may be appreciated that seals, such as O-ring seals 88, are fixed to cover 68 to prohibit any unwanted seepage of fluid into the respective port which they surround.

Turning to FIGS. 6 and 7, a representative one of the jets will now be described. As may be seen, the jet may conveniently be a multi-part housing 88 comprising a pair of concentric rings and an end cap 94. The rings and end cap have seals 96,98 therebetween, and are held together by means of inner and outer threaded concentric rings 100,102, as best seen in FIG. 7.

The jet systems will include a primary jet nozzle 104 in end cap 94. This jet has a nozzle or orifice 106 which is controllable by means of a small fluid control or adjustment screw 108.

Secondary jets 110,112 may be placed on concentric ring 90 as shown. These are similarly constructed in having orifices 114,116 controllable by means of screws 118,120. The secondary jets serve the purpose of cleaning pool side wall surfaces, steps, tile, etc. They may be also used to keep particles in suspension in the pool fluid, thereby assisting the normal skimming system of the pool. The jets are all rotatable 360°.

As seen, threads 122 are included on an extension 124 of the jets for mating with an accomodating wall fitting as would be installed in new pool constructions, in the pool inner surface 14. Obviously, the various rings may be relatively rotated so as to give additional positioning facility to the jet.

As shown in FIG. 8, an alternate embodiment of jet 42 is shown. This embodiment is designed to be used in conjunction with a manifold conduit 58 as previously mentioned. Manifold conduit 58 may be conveniently a rectangular flexible fluid conduit containing therein a plurality (in this case three) of fluid passages 126,128,130. The manifold may conveniently be used in conjunction with already existing pools, where it would be prohibitive to bore additional return lines through the pool walls. The manifold consists of a flexible fluid conduit of plastic or other similar material. A resilient edge or lip at top and bottom 134,136 conforms the manifold to the pool inner surface 14. It may be held in place by means of a wall fastener 136 imbedded in the wall surface and including a screw 138 which is placed through a bore 140 in manifold 58. Obviously, a number of mounting locations are contemplated. Since the manifold is flexible, corners may be easily accomodated. Ends of the manifold (not shown) may be sealed and a particular return line connected to a particular manifold passage as desired. A particular jet 42 may be conveniently attached to the manifold as shown by use of the threaded fitting 124 which is threaded into an accomodating bore 136 in the manifold wall. The number of channels or passages can be varied, and it should be realized that this merely requires a wider manifold.

Turning now to FIGS. 9 and 10, there is shown a large debris trap generally at 62 which is useful in screening out large debris that might otherwise obstruct the drain screen 138, having a plurality of small sized apertures 140 therein. Ordinarily, while small sediment particles would freely pass through the apertures 140, large pieces of debris such as leaves would clog the apertures. As shown, the trap includes a generally disc-shaped body 141 having a resilient skirt 142 around the periphery thereof adapted to sealingly mate with the pool bottom 20. Body 141 contains a central circular depression 144 having a centrally disposed plurality of apertures 146 for screening out debris such as leaves 148, as shown. A dome-shaped cover 150 is sized to fit over body 140 and is supported by a plurality of legs 156 to extend through a respective plurality of accomodating vertical bores 158 within body 141. Each leg has a protuberance or foot portion 160 which is dimensioned to be larger than bore 158 to prevent entire removal of the cover 150. It should be appreciated that the outermost diameter of dome cover 150 is such that the peripheral edge thereof 154 sealingly mates with flexible skirt 142. As shown in FIG. 10, leaves or debris swept along by the automatic pool cleaning system enter the trap 62 through the annular opening formed between periphery 154 and skirt 142. The debris are swept up a ramp portion 160 of body 140 and into depression 144 where they are screened out by orifices 146. Small sediment and fluid pass downwardly and through drain screen 138. Periodically, a hook (not shown) may be extended to the bottom of the pool and engaged with hook eye 162 attached to centrally disposed rod 164 attached to body 141. This rod extends through opening 166 in the top of dome or cover 150. When the hook is pulled in a vertical direction, body 141 will rise vertically in relation to cover 150 until the peripheral edge seals against flexible skirt 142, entrapping leaves and debris. At this point, the trap 62 may be elevated to the surface of the pool and subsequently emptied. The trap may then be relowered to its position over the drain opening.

It is to be understood that the foregoing description is merely illustrative of the preferred embodiments of the invention, and that the scope of the invention is not to be limited thereto, but is to be determined by the scope of the appended claims.

I claim:

1. In a pool cleaning system, a pool structure having an inner surface, a plurality of jet means on said inner surface disposed for directing fluid to said inner surface thereby moving any debris and sediment, a source of fluid under pressure, and, control system means for directing fluid from said source of fluid under pressure selectively to alternate ones of said plurality of jet means so as to sweep said debris and sediment toward and into said drain opening under the action of said plurality of jet means, further including larger debris collection means for preventing larger debris such as leaves from entering said drain opening, said larger debris collection means permitting periodic removal of larger debris collected therein, wherein said larger debris collection means comprises a selectively closeable container positionable over said drain opening and having means for receiving debris and returning larger debris therein while allowing smaller debris and sediment to pass therethrough.

2. In a pool cleaning system, a pool structure having an inner surface, a drain opening in said inner surface, a plurality of jet nozzles in spaced relation on said inner surface disposed for directing fluid to said inner surface thereby moving any debris and sediment, a source of fluid under pressure, and, control system means for directing fluid from said source of fluid under pressure selectively to alternate ones of said plurality of jet nozzles so as to sweep said debris and sediment toward and into said drain opening under the action of said plurality of jet nozzles, wherein the number and location and direction of a first group of said jet nozzles are such that sediment and debris are swept by a first one of said plurality of jet means into the path of a second one of said plurality of jet nozzles, and such alternate sweeping continues in a zig-zag direction from an end of said pool structure removed from said drain opening toward said drain opening until said sediment and debris has reached the vicinity of said drain opening, and wherein the number, location, and direction of a second group of said jet nozzles are such as to impart a spiral motion to the sediment and debris, thereby causing said sediment and debris to enter said drain opening.

3. The invention of claim 1 wherein said pool defines said inner surface by means of generally vertical side walls joined by a generally horizontal bottom wall, said jets are located on said generally vertical side walls, and wherein said first group of jet nozzles are directed to impinge on said bottom wall so as to sweep sediment and debris thereon.

4. The invention of claim 3 wherein said pool defines a peripheral edge and wherein said jet nozzles are located in spaced relation around said peripheral edge.

5. The invention of claim 2 further including conduit means intercommuncating said jet nozzles with said control system means.

6. The invention of claim 5 wherein said conduit means comprises a manifold including a plurality of conduits and wherein said jet nozzles are in communication with a respective one of said plurality of conduits.

7. The invention of claim 6 wherein said conduit is a generally elongated member having a plurality of longitudinally oriented passages therein.

8. The invention of claim 7 further including means for mounting said manifold on said inner surface.

* * * * *